US010221464B2

(12) United States Patent
Ooba et al.

(10) Patent No.: US 10,221,464 B2
(45) Date of Patent: Mar. 5, 2019

(54) EXCELLENT WORKABILITY STEEL WIRE ROD AND METHOD FOR PRODUCTION OF SAME

(71) Applicant: NIPPON STEEL & SUMITOMO METAL CORPORATION, Tokyo (JP)

(72) Inventors: Hiroshi Ooba, Tokyo (JP); Yukihiro Takahashi, Tokyo (JP); Yoshitaka Nishikawa, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 221 days.

(21) Appl. No.: 15/127,142

(22) PCT Filed: Mar. 20, 2015

(86) PCT No.: PCT/JP2015/058566

§ 371 (c)(1),
(2) Date: Sep. 19, 2016

(87) PCT Pub. No.: WO2015/141840

PCT Pub. Date: Sep. 24, 2015

(65) Prior Publication Data

US 2017/0101696 A1 Apr. 13, 2017

(30) Foreign Application Priority Data

Mar. 20, 2014 (JP) ..... 2014-058420

(51) Int. Cl.

| | |
|---|---|
| ***C22C 38/02*** | (2006.01) |
| ***C22C 38/04*** | (2006.01) |
| ***C22C 38/06*** | (2006.01) |
| ***C22C 38/40*** | (2006.01) |
| ***C22C 38/44*** | (2006.01) |
| ***C22C 38/46*** | (2006.01) |
| ***C22C 38/50*** | (2006.01) |
| ***C22C 38/54*** | (2006.01) |
| ***C21D 9/52*** | (2006.01) |
| ***C21D 8/06*** | (2006.01) |
| ***C22C 38/00*** | (2006.01) |
| ***C22C 38/18*** | (2006.01) |
| ***C21D 1/46*** | (2006.01) |

(52) U.S. Cl.

CPC ..... *C21D 9/525* (2013.01); *C21D 1/46* (2013.01); *C21D 8/06* (2013.01); *C21D 8/065* (2013.01); *C22C 38/00* (2013.01); *C22C 38/002* (2013.01); *C22C 38/02* (2013.01); *C22C 38/04* (2013.01); *C22C 38/06* (2013.01); *C22C 38/18* (2013.01); *C22C 38/40* (2013.01); *C22C 38/44* (2013.01); *C22C 38/46* (2013.01); *C22C 38/50* (2013.01); *C22C 38/54* (2013.01); *C21D 9/52* (2013.01); *C21D 2211/003* (2013.01)

(58) Field of Classification Search

CPC ..... C22C 38/02; C22C 38/04; C22C 38/06; C22C 38/40; C22C 38/44; C22C 38/46; C22C 38/50; C22C 38/54; C21D 8/065; C21D 9/525; C21D 2211/003

USPC ..... 420/104, 106, 108, 109, 110, 111, 112, 420/113, 114

See application file for complete search history.

(56) References Cited

U.S. PATENT DOCUMENTS

| | | | | |
|---|---|---|---|---|
| 6,475,306 | B1 * | 11/2002 | Kanisawa | C21D 8/065 148/320 |
| 9,796,158 | B2 * | 10/2017 | Kubota | C22C 38/04 |
| 2013/0037180 | A1 * | 2/2013 | Sano | C22C 38/06 148/603 |
| 2013/0133789 | A1 * | 5/2013 | Okonogi | C22C 38/06 148/596 |
| 2013/0146181 | A1 * | 6/2013 | Kubota | C21D 8/06 420/104 |
| 2013/0183191 | A1 * | 7/2013 | Kaizuka | C22C 38/02 420/104 |
| 2016/0129489 | A1 * | 5/2016 | Okonogi | C21D 8/065 420/91 |

FOREIGN PATENT DOCUMENTS

| | | | |
|---|---|---|---|
| JP | 7-258734 | A | 10/1995 |
| JP | 2000-001751 | * | 1/2000 |
| JP | 2004-68064 | A | 3/2004 |
| JP | 2004-100038 | A | 4/2004 |
| JP | 2006-225701 | A | 8/2006 |
| JP | 2006-316291 | A | 11/2006 |
| JP | 2007-211308 | A | 8/2007 |

(Continued)

OTHER PUBLICATIONS

English translation of JP 2012/140674, Jul. 2012; 21 pages.*

(Continued)

*Primary Examiner* — Helene Klemanski

(74) *Attorney, Agent, or Firm* — Birch, Stewart, Kolasch & Birch, LLP

(57) ABSTRACT

The present invention provides a steel wire rod with stable workability. The steel wire rod has steel components containing, by mass %, C: 0.20 to 0.60%, Si: 0.15 to 0.30%, Mn: 0.25 to 0.60%, P: ≤0.020%, S: ≤0.010%, and a balance of Fe and unavoidable impurities, and an internal microstructure including cementite, in which by number ratio, 80% or more of the cementite in a cross-section vertical to a longitudinal direction of the wire rod has a short axis of 0.1 μm or less and a ratio of a long axis to the short axis, defined as an aspect ratio, of 2.0 or less.

4 Claims, 4 Drawing Sheets

(56) References Cited

FOREIGN PATENT DOCUMENTS

| | | | |
|---|---|---|---|
| JP | 2009-275250 | A | 11/2009 |
| JP | 2012-140674 | A | 7/2012 |
| KR | 10-2007-0086836 | A | 8/2007 |
| WO | WO 2011/062012 | A1 | 5/2011 |

OTHER PUBLICATIONS

English translation of JP 2000/001751, Jan. 2000; 8 pages.*
International Search Report for PCT/JP2015/058566 dated Jun. 16, 2015.
Written Opinion of the International Searching Authority for PCT/JP2015/058566 (PCT/ISA/237) dated Jun. 16, 2015.

* cited by examiner

SCHEMATIC VIEW OF MEASUREMENT BY FOUR-PROBE METHOD (A)

(B)

(A)

(B)

EXCELLENT WORKABILITY STEEL WIRE ROD AND METHOD FOR PRODUCTION OF SAME

TECHNICAL FIELD

The present invention is an invention which improves the workability of steel wire rod by the effect such as delaying formation of internal microvoids, which is the elementary step of causing fracturing or cracking on working process such as forging that is a typical process of wire drawing or bolt formation and that is said to be essential in production processes using wire rod to produce products. This invention is characterized by being applicable to the general fields of working of steel wire rods.

BACKGROUND ART

The most generally used technology in the prior art for improving the workability of steel wire rod is the method of performing spheroidizing annealing. The prior art utilizing spheroidizing annealing, as shown in PLT 1, includes making the grain size of the austenite crystal 100 μm or more and making the volume fraction of ferrite 20% or less. In particular, as a method for promoting spheroidizing of cementite after annealing, Cr is added.

In this prior art, to secure forgeability, the grain size of the austenite crystal has to be made 100 μm or more, so when performing a forging operation in which a free surface is exposed and worked instead of performing an upset operation, the skin of the free surface part is caused to be uneven in shape. If the extent of this is severe, the result may become to be relatively noticeable unevenness like an orange peel. Depending on use for products, the unevenness may become a problem. Further, since a lot of Cr is added for improving the formation of cementite, the cost of the alloy steel also becomes somewhat higher and other problems are incurred.

PLT 2 controls the structure of a steel material so as to give degenerate pearlite: 10 area % or more, bainite: 75 area % or less, and ferrite: 60 area % or less, and achieves both shortening of the spheroidizing annealing time of the steel material and improvement of the workability and reduction of the deformation resistance after spheroidizing.

Further, PLT 2 restricts the area % of degenerate pearlite, bainite, and ferrite to desirable ranges to thereby achieve a balance of workability and deformation resistance and obtain a steel wire rod exhibiting excellent cold formability.

Further, PLT 3 describes a method for producing a rolled steel wire made of steel such as eutectoid steel. The method is characterized by producing a high tensile strength steel wire having excellent wire drawability by performing heat treatment for isothermal transformation immediately after completing the rolling without allowing the steel material to be transformed from the austenite phase in the integrated process from casting to wire rod rolling.

However, in PLTs 1 to 4, causes by which steel wire tends to be easily broken at the time of severely working steel wire rod to produce steel wire have not been researched. Further, the effects of the behavior of microvoids formed at the time of shaping steel wire rod into steel wire on the breakage of steel wire have not been researched.

CITATION LIST

Patent Literature

PLT 1: Japanese Patent Publication No. 2004-68064A
PLT 2: Japanese Patent Publication No. 2006-225701A PLT 3: Japanese Patent Publication No. 2009-275250A
PLT 4: Japanese Patent Publication No. 7-258734A

SUMMARY OF INVENTION

Technical Problem

The present invention was made in consideration of such a situation and has as its object the provision of steel wire rod having stable workability, which is characterized by having a microstructural morphology of cementite designed for delay of formation of microvoids at the inside during a working operation so as to realize stable wire drawability and forgeability.

Solution to Problem

To achieve the above object, the gist of the present invention is as follows:

(1) An excellent workability steel wire rod comprising steel components including, by mass %, C: 0.20 to 0.60%, Si: 0.15 to 0.30%, Mn: 0.25 to 0.60%, P: ≤0.020%, S: ≤0.010%, and a balance of Fe and unavoidable impurities, and an inside microstructure including cementite, wherein by number ratio, 80% or more of the cementite in a cross-section vertical to a longitudinal direction of the wire rod has a short axis of 0.1 μm or less and a ratio of a long axis to the short axis, defined as an aspect ratio, of 2.0 or less.

(2) The excellent workability steel wire rod according to (1) further containing, in addition to the steel components, by mass %, one or more of Al: 0.06% or less, Cr: 1.5% or less, Mo: 0.50% or less, Ni: 1.00% or less, V: 0.50% or less, B: 0.005% or less, and Ti: 0.05% or less.

(3) A method for production of an excellent workability steel wire rod excellent in drawability and forgeability comprising heating a billet of a chemical composition according to (1) or (2) to 950° C. to 1080° C., supplying the billet to a wire rod rolling process to obtain a wire rod, coiling the wire rod in a temperature region of 750° C. to 900° C., then subjecting the wire rod to in-line heat treatment by a molten salt of 400° C. to 430° C., and ejecting the molten salt to the wire rod being dipped in the molten salt at a stirring flow rate of 0.5 m/s to 2.0 m/s in range.

Advantageous Effects of Invention

The present invention suppresses wire breakage and cracking during working operations in the fields of typical processes of manufacture of steel wire rod such as wire drawing or cold forging, enables the provision of a wire rod having excellent workability, and contributes to the stabilization of production activities in the above-mentioned fields.

BRIEF DESCRIPTION OF DRAWINGS

FIG. 4A is a schematic top view explaining an in-line heat treatment process of a steel wire rod, while FIG. 4B is a schematic side cross-sectional view explaining an in-line heat treatment process of a steel wire rod.

FIG. 5A is a schematic front cross-sectional view of an apparatus 10 for performing an in-line heat treatment process comprising a cooling tank in which piping 2 is laid for discharging molten salt A, while FIG. 5B is a schematic side cross-sectional view of the apparatus 10.

DESCRIPTION OF EMBODIMENTS

Figure 1:
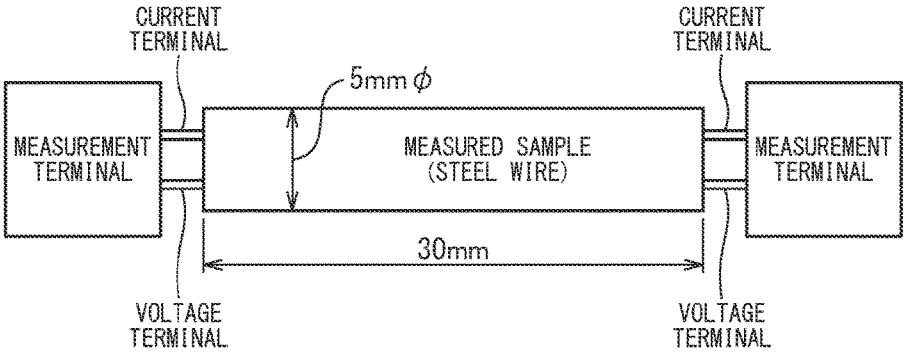
FIG. 1 is a view showing an outline of a method for measuring electrical resistance.

Below, the steel components according to the present invention, the aspect ratio (long axis)/(short axis) relating to the microstructural morphology of cementite, the abundance ratios of different aspect ratios in the total amount of cementite in a cross-section, the short axis sizes, and details relating to the method for production, particularly reasons for defining the lower limits and upper limits of the suitable ranges, will be specifically explained. The "%" relating to the steel components all show mass %.

C: 0.20 to 0.60%

C, as is well known, is an element required for securing strength. If less than 0.20%, a suitable strength in the application can no longer be held. If over 0.60%, at the time of cold forging, the load stress becomes higher, so the lifetime of the forging punch etc. come to be affected.

Si: 0.15 to 0.30%

Si is used as a deoxidizing material. If the amount of Si is less than 0.15%, the deoxidation becomes insufficient and surface defects due to pinhole defects which were formed at the casting stage are caused at the surface part of the billet. Further, if the amount of Si being over 0.30%, selective oxidation at the stage of heating the billet causes Si to concentrate at the interface between scale and base iron. In view of concern for having a detrimental effect on the descaling ability, the upper limit was made 0.30%.

Mn: 0.25 to 0.60%

Mn, like Si, is an element required for deoxidation. Further, it is an element important for securing the ductility during hot rolling. The lower limit was made 0.25% to avoid insufficient deoxidation. Further, the upper limit was made 0.60% because addition over this amount would result in an increase of solid solution strengthening amount, raise the deformation resistance at the time of forging, and thereby invite deterioration of tool life.

P: ≤0.020%

P is an element having the feature of causing deterioration of the ductility of the steel material. Further, the segregation ratio of P is also high, so concentration of P easily occurs at the segregation portions caused in the production stage. For this reason, the upper limit of P was made 0.020%.

S: ≤0.010%

S bonds to Mn in the steel to produce MnS. Further, S segregates at the center part in the processes between refining process of the steel and solidification process of the steel, so MnS becomes denser at the center part. If S exceeds 0.010%, at the time of wire drawing etc., internal cracks may occur and the wire may break. Therefore, S is made 0.010% or less.

The basic composition of chemical components in the steel wire rod of the present invention is as mentioned above. If further including, in addition to the above composition, one or more elements selected from the group comprised of Al: 0.06% or less, Cr: 1.50% or less, Mo: 0.50% or less, Ni: 1.00% or less, V: 0.50% or less, B: 0.005% or less, and Ti: 0.05% or less, the advantages are obtained of improvement of the hardenability and improvement of the strength in cold forging.

Al: 0.06% or less

Al has the effect of fixing N to suppress dynamic strain aging during cold forging and reduce the deformation resistance. To obtain this effect, it is preferable to include at least 0.01%. However, if Al is included in excess, it makes the toughness fall, so the upper limit of Al is made 0.06%.

Cr: 1.50% or less, Mo: 0.50% or less, and Ni: 1.00% or less

Cr, Mo, and Ni are elements effective for improving the hardenability. However, if included in excess, they cause deterioration of the ductility, so the contents are kept to within the above ranges.

V: 0.50% or less

V may be added for the purpose of precipitation strengthening. However, if V is added in a large amount, deterioration of the ductility is caused, so the content is kept to within the above range.

B: 0.0050% or less and Ti: 0.05% or less B is an element for improving the hardenability and may be added as necessary. However, if included in excess, it causes deterioration of the toughness, so the upper limit is made 0.005%. Ti is an element effective for the reduction of the deformation resistance at the time of cold forging by the effect of suppression of dynamic aging owing to fixing of solid solution N, so may be added as necessary. However, if Ti is included in excess, coarse TiN precipitates, the coarse TiN acts as initiation points, and cracking is likely to occur, so the upper limit is made 0.05%.

Next, the reasons for limitation of the aspect ratio of cementite will be explained. As a method for obtaining a grasp of the effect of the cementite shape on the workability, the inventors used a die with a larger approach angle than a usually used wire drawing die so as to intentionally severely process a material and engaged in various studies on the occurrence of microvoids formed at the inside. As a result, they found that the shapes of microvoids generated at the interface part between the cementite and base iron have the following features.

The inventors performed drawing processes using various types of steel wire rods in which the aspect ratios are different from each other by highly angled dies (approach angle 30°) in single passes (25% drawing reduction of area), observed the microvoids in the cross-sections of the drawn steel wires, and measured the shapes of the generated voids and the ratios of the shapes. Specific examples of the observations are shown in Table 1. The observation was performed by taking 10000× SEM photographs of 265 $\mu m^2$ area region at the three locations of the surface layer part, ¼D part (D: diameters of wire rods), and center part, respectively. When the aspect ratio of the cementite shape was 2 or less, the ratio at which microvoids exist individually became extremely high. On the other hand, with regard to cementite formed in a lamellar shape (aspect ratio: 10 or more), the ratio at which microvoids are connected to each other in adjoining cementites was high. Further, with an aspect ratio of 2 to 10 in range, there was a mixture of both independent and connected types. However, observation by this method is limited to a local visual field in a cross-section.

Therefore, in order to increase the volume of observation and stably get a grasp of formation of internal microvoids, the inventors produced steel wires by using the Steel Wire Rod Nos. 1 to 6 of the present invention and the Steel Wire Rod Nos. 11 to 16 of the comparative examples shown in Table 3 and attempted to measure the electrical resistances of the steel wires by the four-probe method shown in FIG. 1.

TABLE 1

State of Generation of Voids by Aspect Ratio and Ratios of Voids of Those Types (%)

| Features of void shapes | Aspect ratio of cementite: 0 to 2 | Over 2 to less than 10 | 10 or more |
|---|---|---|---|
| Independent | 93.1 | 5.7 | 1.1 |
| Connected | 1.2 | 20.3 | 78.6 |

Figure 2:
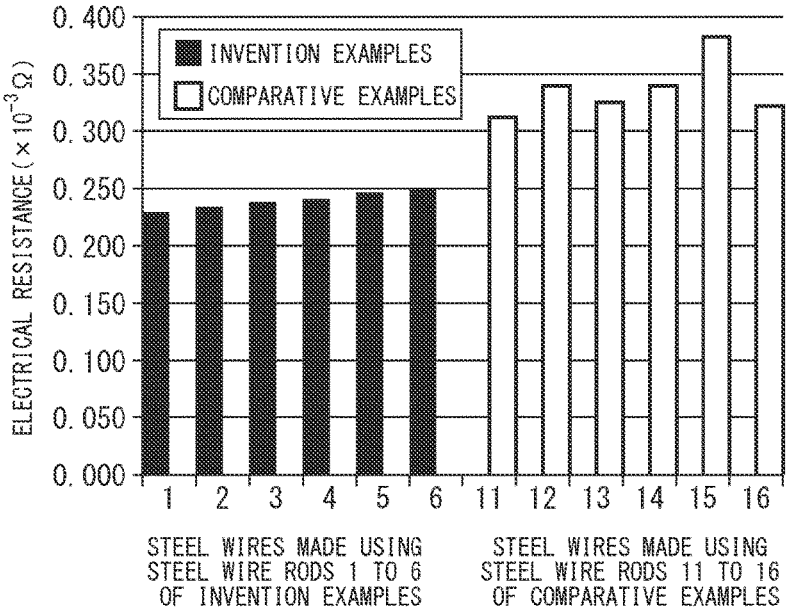
FIG. 2 is a comparative view showing a difference in electrical resistances of steel wire rods of the present invention and the prior art.

The results are shown in FIG. 2. As imagined from the shapes of the voids actually observed, it was confirmed that steel wires made of the steel wire rods of the present invention are suppressed more in formation of internal microvoids and are lower in electrical resistance values since the numbers of generation of microvoids are smaller. Based on the results of these measurements, in the course of getting a grasp of the state of generation of internal microvoids and observing in detail the microstructural morphology, the inventors discovered that there is a close relationship between the formation of microvoids and the form of cementite by initially applying wire drawing conditions severer than usual to artificially cause the formation of microvoids. When focusing on the shape of the cementite, it was found that if the ratio of the long axis to the short axis (below, called the "aspect ratio") is 2 or less, cracks independently occur from the interface of the base iron around the cementite.

On the other hand, in Table 1, if the aspect ratio is over 2 to 10, while the trends differ depending on the distance between adjoining cementite crystals, both the independent and connected forms appear. Furthermore, if the aspect ratio exceeds 10, the connected form increases. This trend is also shown in Table 1. Based on these findings, the inventors obtained the findings that by suppressing the aspect ratio of the cementite to 2 or less, the formation of internal microvoids is suppressed and that controlling microvoids to independent ones which are hard to connect to each other is effective for providing wire rod excellent in the wire drawability and forgeability.

Based on the above results of study, the reasons for limitation of the microstructural morphology will be explained below.

<Aspect Ratio: 1 to 2>

The aspect ratio is made 2 or less because of the following: As shown in Table 1, after artificially severe wire drawing was performed to inflict damage on the cementite, microvoids were formed. The inventors researched the formation of the microvoids in detail, and they acquired insights into the formation of the microvoids. From their insights into the formation of the microvoids, the ratio of microvoids whereby independent microvoids are formed and do not easily connect to each other becomes highest when an aspect ratio is 2 or less. The aspect ratio was determined based on the result of this observation. Further, if the ratio, that is, abundance ratio, of cementite with an aspect ratio of 1 to 2 is 80% or more in a cross-section, the desired workability is obtained. Therefore, the lower limit of the abundance ratio is made 80%. If the abundance ratio is less than 80%, the ratio of the independent microvoids connecting together rises and the workability is affected.

<Reasons for Limitation of Short Axis of Cementite>

Figure 3:
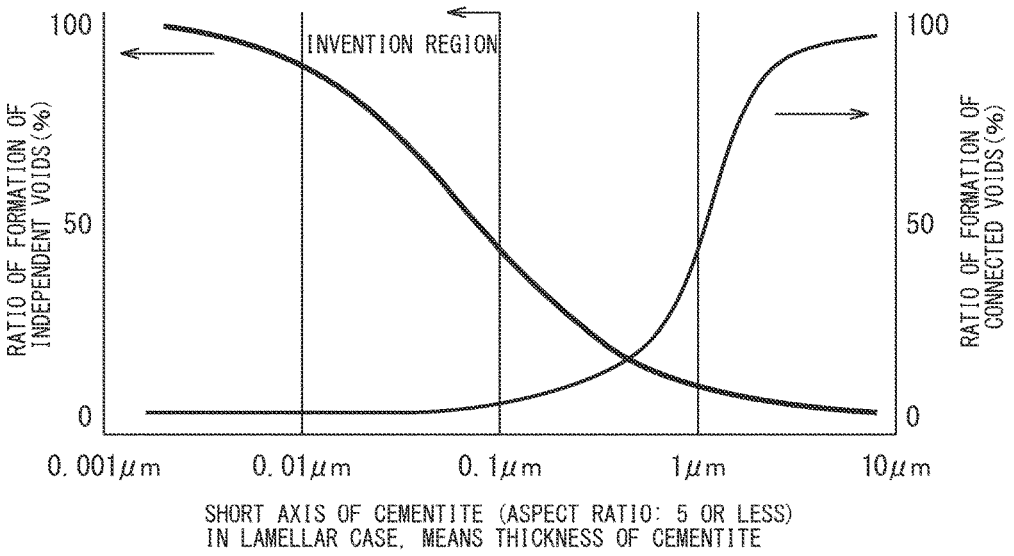
FIG. 3 is a graph showing a relationship between a void shape and cementite short axis.

The short axis of the cementite is made 0.1 μm or less so as to make connection of adjoining voids difficult at the stage of formation of microvoids as shown in FIG. 3. If over this value, the voids are easy to connect to each other. Further, if the cementite further increases in thickness and becomes 5 μm or more, formation of microvoids due to cracking of the cementite itself will be invited and detrimental effects other than the fracture mode related to the technical problem to be solved by the present invention will appear. Therefore, the short axis of the cementite was defined as 0.1 μm or less.

<Reasons for Limitation of Ratio of Lamellar Type Structures>

The microstructure varies depending on the difference of the cooling speed at the different portions in a cross-section arising at the stage of production of the wire rods, so there is an inherent limit to how uniform a microstructure in the overall cross-section can be made. It is difficult to make the ratio of the lamellar type structures 0. Various tests were performed. As a result, it could be confirmed that if the ratio of lamellar type structures is less than 5%, there was little effect on the workability. Therefore, the upper limit of the ratio of lamellar type structures is defined as 5%.

Next, the method for production of the excellent workability steel wire rod of the present invention will be explained.

<Processes of Heating of Billet and Rolling of Wire Rod>

The billet is heated to 950° C. to 1080° C. in range. After heating, the billet is rolled to a wire rod. If less than 950° C., within the usual holding time, the internal imbalance of heat inside the billet becomes greater and warp of the steel material at the time of rolling or problems accompanying the increase in the reaction force arise. Further, the upper limit temperature is made 1080° C. because if the heating temperature is more than that, the γ (austenite) grain size will easily increase etc. Such an increase in γ grain size more than necessary would affect the skin quality of the free surface of the final product, so the upper limit is made 1080° C.

<Coiling Process>

After the heating process, the steel piece is coiled up at a temperature of 750° C. to 900° C. in range. The lower limit temperature varies somewhat due to the size of the rolled wire rod, but is made 750° C. to stably perform the heat treatment after coiling. Further, if less than 750° C., pearlite transformation occurs before the heat treatment and the targeted metal microstructure can no longer be obtained. On the other hand, coiling at a temperature over 900° C. would invite an increase in surface oxidation etc. so is not desirable.

<In-Line Heat Treatment>

In-line heat treatment is performed by dipping the wire rod after the coiling process in a cooling tank containing a molten salt of at least one of potassium nitrate and sodium nitrate and of 400° C. to 430° C. while stirring at a predetermined flow rate. The lower limit temperature of the in-line heat treatment temperature is made 400° C. because with a temperature less than that, a lower bainite structure is formed and the hardness of the material rapidly ends up increasing, so the lifetime of a tool used in a forging process etc. deteriorates. The upper limit temperature of the heat treatment is made 430° C. because if a temperature over this, there would be regions where degenerate pearlite structures are mixed into the upper bainite, so control of the aspect ratio of the cementite would become difficult and the effect of delaying formation of microvoids, which is the most important in the present invention, would no longer be able to be exhibited.

The condition which plays an important role in the present invention is not only the above in-line heat treatment temperature, but also the stirring flow rate creating the jet flow explained here.

In the above-mentioned in-line heat treatment, the steel wire rod is dipped in the cooling tank in the form of a loose coil or other coil. In this case, even if the flow of the molten salt in the cooling tank is maintained in a constant direction, since the steel wire rod being heat-treated is a coil in shape, the direction in which the molten salt strikes the steel wire rod will differ depending on the location. It is considered de facto difficult to make the direction of impact constant.

Therefore, it is thought that not only the flow rate, but also the effect of the direction in which the molten salt strikes the steel wire rod is an important technical issue in realizing the present invention. With that in mind, the effect was investigated. The relationship between typical directions of the flow of molten salt such as directions parallel to the conveyance direction (F) of the steel wire rod (D11 and D12 of FIGS. 4A and 4B), directions vertical to the coil surface of the steel wire rod (directions D31 and D32 of FIG. 4B), and directions horizontal to coil surface of steel wire rod and vertical to conveyance direction (F) (directions D21 and D22 of FIG. 4A) and the abundance ratio of cementite with an aspect ratio of 2 or less with respect to the total amount of cementite in the cross-section was investigated.

Figure 4:
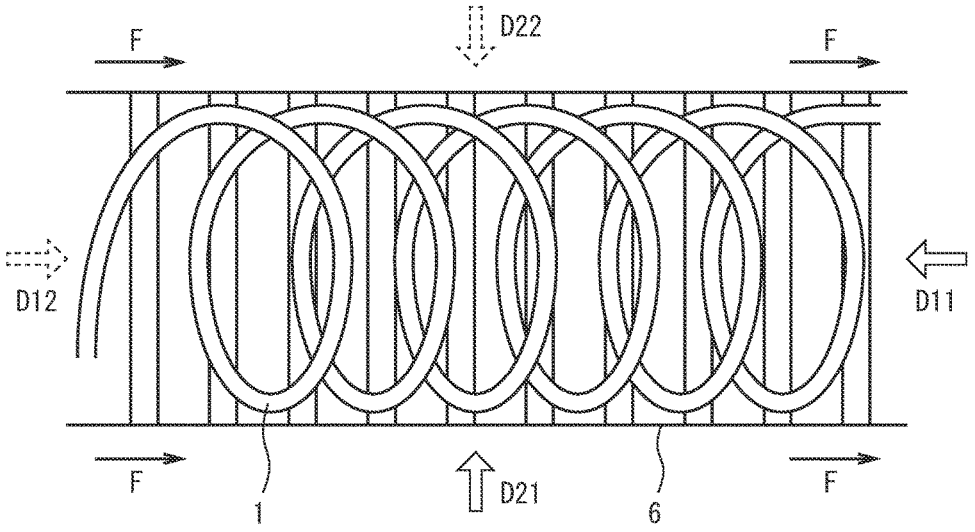
Figure 4:
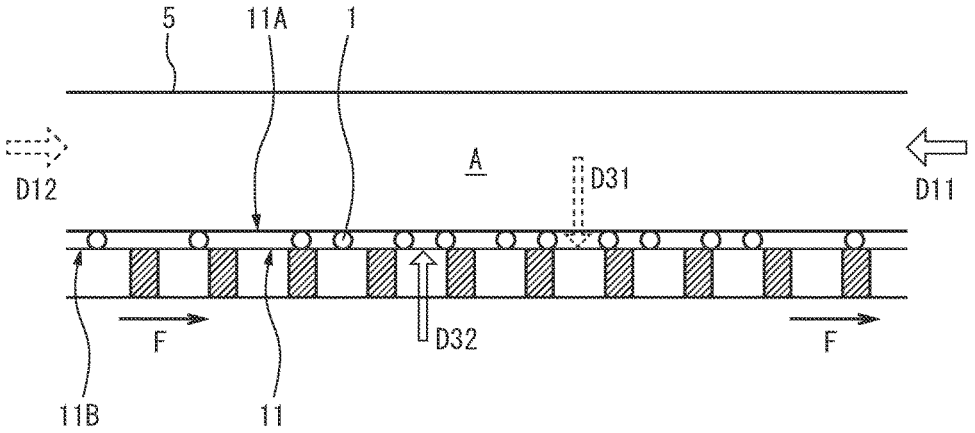

As shown in FIG. 4A and FIG. 4B, the directions D12, D22 and D32 were made positive directions and the directions D11, D21, and D31 were made negative directions. The maximum flow rates and the minimum flow rates of the molten salt A in each of three directions vertical to each other were measured near the coil surfaces 11A and 11B of the steel wire rod 1, respectively. The average flow rates in each of the three directions vertical to each other, calculated on the basis of the maximum flow rates and the minimum flow rates, were defined as the "stirring flow rate vectors" and the magnitudes of the stirring flow rate vectors were defined as the "stirring flow rates". The relationship between the stirring flow rate of the molten salt and the abundance ratio of the cementite was investigated. As a result, it was found that if the steel wire rod is a coil shape, if the stirring flow rate of the molten salt is 0.5 m/s or more with respect to the coil surfaces of the steel wire rod, the uniformity of the material quality in the cross-section can be improved to a level not substantially posing any problems.

Further, if the stirring flow rate is less than 0.5 m/s with respect to the coil surfaces, the cooling of the wire rod by the molten salt becomes insufficient and control to make the aspect ratio of the cementite 2 or less can no longer be stably performed. On the other hand, if making the stirring speed over 2 m/s with respect to the coil surfaces, a rise in pressure of the stirring flow in the molten salt is invited, the material being heat treated, that is, the wire rod coil, starts to shake and, therefore conveyance becomes unstable etc. The upper limit of the stirring flow rate is limited from the viewpoint of operational stability.

The positions for measurement of the stirring flow rate may be the gap between adjoining rollers of the conveyor rollers 6, for example. Further, the stirring flow rate is particularly preferably measured at a position where the flow rates up to reaching the coil surfaces 11A and 11B are maintained to be substantially constant.

Further, with regard to the method of using a gas as a medium for driving the stirring, the cooling of the wire rod by the molten salt becomes insufficient, so the aspect ratio of the cementite may be unable to be controlled to 2 or less. Therefore, the wire rod may be cooled either by using a stirring machine to directly stir the molten salt in the cooling tank or by discharging the molten salt itself into the molten salt in the cooling tank.

EXAMPLES

Below, examples will be used to show the advantageous effects of the present invention. Table 2-1 shows the chemical components of the test steels used for the tests.

Each steel of Table 2-1 was smelted, then continuously cast into a 300 mm×500 mm casting size, and then was bloomed to a 122 mm square billet. The billet was reheated, and then rolled to obtain a wire rod. The Wire Rod Nos. 1 to 10 of the invention examples and Wire Rod Nos. 18 to 21 were coiled, then dipped in molten salt in the in-line heat treatment apparatus 10 shown in FIGS. 5A and 5B for direct heat treatment to obtain 5.5 mm(ϕ) wire rods. The Wire Rod No. 11 was directly cooled in the molten salt without stirring the molten salt after rolling the wire rod. Further, Wire Rod Nos. 12 to 17 are cases of comparative examples, which were obtained by continuous casting to obtain cast billets of the same sizes, then blooming them to obtain billets of the same sizes, and then rolling them to obtain 5.5 mm(ϕ) wire rods with air blast cooling for heat treatment after the wire rod rolling.

Figure 5:
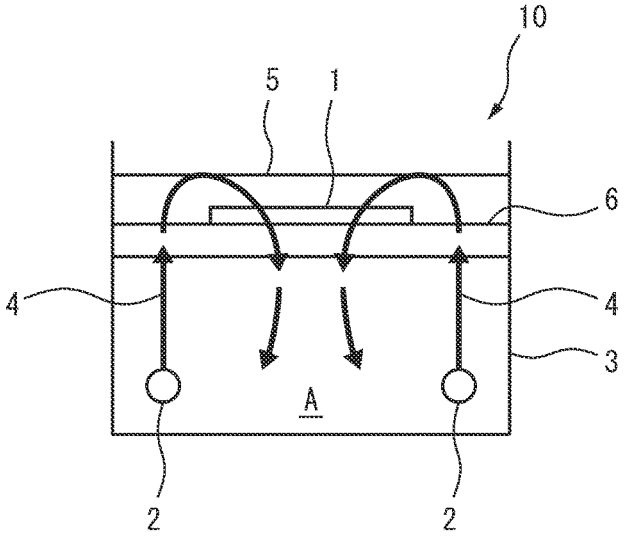
Figure 5:
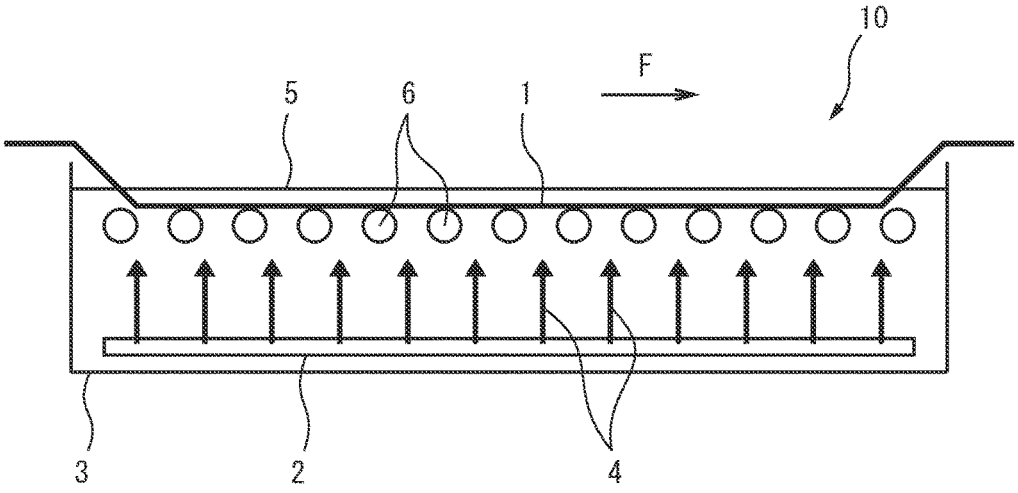

The in-line heat treatment of the wire rod after coiling, as shown in FIGS. 5A and 5B, was performed by conveying the steel wire rod 1 using the conveyor rollers 6 in the in-line heat treatment apparatus 10 in the F direction so that the entire coil shaped steel wire rod 1 was dipped below the surface 5 of the molten salt A. The in-line heat treatment apparatus 10 is structured so as to have a cooling tank 3 in which piping 2 is laid for discharging molten salt A. The piping 2 discharges molten salt A toward the wire rod 1 from the lower side to the upper side so as to create a flow 4 of molten salt vertical to the coil surfaces 11 of the wire rod 1.

The stirring flow rate was calculated as the average speed of the maximum speed and the minimum speed of the flow 4 of the molten salt near the coil surfaces 11 of the steel wire rod 1.

As will be understood from Table 2-2, the method for production of a wire rod according to the present invention is characterized by dipping a wire rod in a molten salt of 400 to 430° C. which is relatively lower in temperature as a direct heat treatment after wire rod rolling and making the molten salt accompanied with a stirring flow contact the heat treated material to thereby strengthen the dipped wire rod by removal of heat.

For this reason, unlike the wire rods of the comparative examples, the microstructures of the steel wire rods according to the present invention present F (ferrite)+B (bainite). On the other hand, it is understood that the microstructural morphologies of the steel wire rods of the comparative examples present F+P (pearlite) structure since the wire rod cooling speed becomes slower than that in the method for production according to the present invention. Next, as will be understood from Table 3, the difference in the types of microstructural morphologies appears in a factor of form of cementite, that is, the aspect ratio.

That is, in the case of the steel wire rod of the present invention, the temperature of the heat treatment medium enables the aspect ratio to be made smaller compared with the case of production by the usual air blast cooling and easily enables the aspect ratio of 2 or less to be achieved. On the other hand, the Wire Rod Nos. 12 to 17 of the comparative examples have lamellar structures, so it is understood that the abundance ratios of cementite with aspect ratios of 2 or less become extremely small. Further, in each of the Wire Rod Nos. 18 to 21 of the comparative examples, amount of cementite with an aspect ratio of 2 or less is less than 80% in the cross-section. This is due to the fact that during the in-line heat treatment, the stirring flow rate of the molten salt was less than 0.5 m/s, so the wire rods were not sufficiently cooled by the molten salt.

The Wire Rod Nos. 1 to 21 were measured for abundance ratios of cementite with short axes of 0.1 μm or less and with aspect ratios of 2 or less among cementites in the cross-sections vertical to a direction of the wire rod. Further, the Wire Rod Nos. 1 to 21 were drawn and measured for wire drawability, forgeability, and electrical resistance and measured for numbers of microvoids. The results are shown in Table 3.

First, as shown in Table 3, when wire drawing the steel wire rods of the invention examples and the steel wire rods of the comparative examples using dies which have die half angles of 5°, no large difference is observed between the workabilities of the two. Therefore, the inventors provided intentionally severe wire drawing conditions by using a die having a die half angle of 15°, and performed wire drawing. As a result, as shown in Table 3, it was found that the features of the steel of the present invention appeared and no generation of microvoids could be observed inside at the time of performing one die drawing of a 5.5 mm to 5 mm, while in the case of steel wire rods of the comparative examples, microvoids were generated in the inside.

TABLE 2-1

| Steel | Chemical components (mass %) | | | | | | | | | | | |
|---|---|---|---|---|---|---|---|---|---|---|---|---|
| type | C | Si | Mn | P | S | Al | Cr | Mo | Ni | V | Ti | B |
| A | 0.20 | 0.15 | 0.25 | 0.010 | 0.005 | — | — | — | — | — | — | — |
| B | 0.25 | 0.16 | 0.30 | 0.012 | 0.007 | — | — | — | — | — | — | — |
| C | 0.30 | 0.28 | 0.35 | 0.014 | 0.009 | — | — | — | — | — | — | — |
| D | 0.35 | 0.20 | 0.40 | 0.015 | 0.006 | — | — | — | — | — | — | — |
| E | 0.45 | 0.25 | 0.35 | 0.019 | 0.005 | — | — | — | — | — | — | — |
| F | 0.60 | 0.30 | 0.60 | 0.020 | 0.010 | — | — | — | — | — | — | — |
| G | 0.20 | 0.15 | 0.60 | 0.010 | 0.010 | 0.039 | 0.02 | 0.01 | 0.02 | — | — | — |
| H | 0.23 | 0.16 | 0.60 | 0.015 | 0.010 | 0.031 | 0.15 | — | 0.02 | 0.01 | 0.03 | 0.0015 |
| I | 0.42 | 0.20 | 0.60 | 0.020 | 0.010 | 0.026 | 1.09 | — | 1.00 | — | — | — |
| J | 0.24 | 0.22 | 0.51 | 0.020 | 0.009 | 0.026 | 1.50 | — | 0.26 | — | — | — |
| K | 0.45 | 0.30 | 0.50 | 0.020 | 0.010 | — | — | — | — | — | — | — |
| L | 0.20 | 0.15 | 0.25 | 0.010 | 0.005 | — | — | — | — | — | — | — |
| M | 0.25 | 0.16 | 0.30 | 0.012 | 0.007 | — | — | — | — | — | — | — |
| N | 0.30 | 0.28 | 0.35 | 0.014 | 0.009 | — | — | — | — | — | — | — |
| O | 0.35 | 0.20 | 0.40 | 0.015 | 0.006 | — | — | — | — | — | — | — |
| P | 0.45 | 0.25 | 0.35 | 0.019 | 0.005 | — | — | — | — | — | — | — |
| Q | 0.60 | 0.30 | 0.60 | 0.020 | 0.010 | — | — | — | — | — | — | — |

(in the table "—" indicates the amount of addition of the corresponding element to the steel material is 0 wt %.)

TABLE 2-2

| Class | Wire rod No. | Steel type | Cooling medium | Heating temp. ° C. | Coiling temp. ° C. | Coolant temp. ° C. | Stirring flow rate m/s | Micro-structural morphology |
|---|---|---|---|---|---|---|---|---|
| Inv. ex. | 1 | A | Molten salt | 1080 | 750 | 400 | 0.5 | F + B |
| | 2 | B | Molten salt | 950 | 770 | 410 | 1 | F + B |
| | 3 | C | Molten salt | 1000 | 800 | 420 | 1.1 | F + B |
| | 4 | D | Molten salt | 980 | 850 | 417 | 1.5 | F + B |
| | 5 | E | Molten salt | 1020 | 875 | 415 | 1.7 | F + B |
| | 6 | F | Molten salt | 1050 | 900 | 430 | 1.9 | F + B |
| | 7 | G | Molten salt | 1080 | 750 | 400 | 0.5 | F + B |
| | 8 | H | Molten salt | 1080 | 750 | 400 | 0.5 | F + B |
| | 9 | I | Molten salt | 1080 | 750 | 400 | 0.5 | F + B |
| | 10 | J | Molten salt | 1080 | 750 | 400 | 0.5 | F + B |
| Comp. ex. | 11 | K | Molten salt | 1050 | 900 | 425 | None | F + B |
| | 12 | L | Air blast cooling | 1100 | 850 | Room temp. | None | F + P |
| | 13 | M | Air blast cooling | 1080 | 850 | Room temp. | None | F + P |
| | 14 | N | Air blast cooling | 1100 | 850 | Room temp. | None | F + P |
| | 15 | O | Air blast cooling | 1120 | 850 | Room temp. | None | F + P |
| | 16 | P | Air blast cooling | 1080 | 850 | Room temp. | None | F + P |
| | 17 | Q | Air blast cooling | 1090 | 850 | Room temp. | None | F + P |
| | 18 | G | Molten salt | 1050 | 900 | 425 | 0.3 | F + P |
| | 19 | H | Molten salt | 1050 | 900 | 425 | 0.3 | F + P |
| | 20 | I | Molten salt | 1050 | 900 | 425 | 0.3 | F + P |
| | 21 | J | Molten salt | 1050 | 900 | 425 | 0.3 | F + P |

TABLE 3

| Class | Wire rod No. | Steel type | Type of structures | Amount of cementite with aspect ratio of 2 or less (%) (*1) | Wire drawability (*2) | High angle wire drawing (*3) (%) | Forgeability | Electrical resistance ($\times 10^{-3}$ Ω) | Number of microvoids |
|---|---|---|---|---|---|---|---|---|---|
| Inv. | 1 | A | F + B | 96 | ○ | ○ | 0 | 0.230 | 0 |
| ex. | 2 | B | F + B | 93 | ○ | ○ | 0 | 0.234 | 0 |
| | 3 | C | F + B | 88 | ○ | ○ | 0 | 0.239 | 0 |
| | 4 | D | F + B | 94 | ○ | ○ | 0 | 0.241 | 0 |
| | 5 | E | F + B | 92 | ○ | ○ | 0 | 0.247 | 0 |
| | 6 | F | F + B | 81 | ○ | ○ | 0 | 0.250 | 0 |
| | 7 | G | F + B | 85 | ○ | ○ | 0 | 0.242 | 0 |
| | 8 | H | F + B | 87 | ○ | ○ | 0 | 0.240 | 0 |
| | 9 | I | F + B | 88 | ○ | ○ | 0 | 0.241 | 0 |
| | 10 | J | F + B | 87 | ○ | ○ | 0 | 0.240 | 0 |
| Comp. | 11 | K | F + B | 75 | ○ | Δ | 50 | 0.280 | 18 |
| ex. | 12 | L | F + P | 5 | ○ | Δ | 60 | 0.298 | 16 |
| | 13 | M | F + P | 0 | ○ | Δ | 60 | 0.295 | 15 |
| | 14 | N | F + P | 3 | ○ | x | 80 | 0.302 | 40 |
| | 15 | O | F + P | 6 | ○ | x | 80 | 0.315 | 43 |
| | 16 | P | F + P | 2 | ○ | x | 100 | 0.365 | 38 |
| | 17 | Q | F + P | 1 | ○ | x | 100 | 0.380 | 49 |
| | 18 | G | F + P | 78 | ○ | Δ | 45 | 0.275 | 12 |
| | 19 | H | F + P | 77 | ○ | Δ | 45 | 0.273 | 10 |
| | 20 | I | F + P | 76 | ○ | Δ | 47 | 0.271 | 9 |
| | 21 | J | F + P | 78 | ○ | Δ | 46 | 0.272 | 10 |

(*1): Abundance ratio of cementite with short axis of 0.1 μm or less and with aspect ratio of 2 or less among cementite in cross-section vertical to longitudinal direction of wire rod.
(*2): Die half angle: wire drawing by 5°.
(*3): Die half angle: wiring drawing by 15°

The amounts of cementite with aspect ratios of 2 or less in Wire Rod Nos. 1 to 10 corresponding to the invention examples were 80% or more. Further, in the Steel Wire Rod Nos. 12 to 17 of Table 3, the majority of the cementite was a lamellar type, and the abundance ratio of the area of cementite with a short axis of 0.1 lam and an aspect ratio of 2 or less (Table 3, "Amount of cementite with aspect ratio of 2 or less (%)") was only 6% or less.

On the other hand, if comparing the test results of the wire drawability using dies with die half angles of 15° between the Steel Wire Rod Nos. 1 to 10 (invention examples) and the Steel Wire Rod Nos. 11 to 21 (comparative examples), the steel wire rods of the invention examples have higher ductility due to the delayed generation of microvoids.

From this result, it is understood that the high ductility due to the delayed generation of microvoids appears in a region where the average value of the aspect ratio is 2 or less and the abundance ratio is 80% or more.

Further, from the results of Table 3, it could be confirmed that if the number of microvoids actually generated becomes greater, the drawn steel wire also increases in electrical resistance.

That is, as shown in Table 3, it was confirmed that the steel wires of the present invention have electrical conductivities of 0.23 to $0.25\times10^{-3}$ Ω in range, while the steel wires of the comparative examples have higher electrical conductivities of 0.28 to $0.38\times10^{-3}$ Ω in range. Compared with the steel wires of the present invention, it could be confirmed that steel wires of the comparative examples had clearly greater numbers of generated microvoids.

The electrical resistivity was measured using the four-probe method shown in FIG. 1. Further, the number of microvoids was measured by drawing by a high angle die (approach angle: 30°) by one pass (25% drawing reduction of area), observing the microvoids present in a 2.4 mm×3.2 mm area at 500×, and counting the number of visually discernable microvoids.

The above-mentioned differences in the number of internal microvoids generated appear in the forgeability as an effect on actual workability.

Test pieces with L/D ratios (L: length, D: diameter) of 1.5 were given V-notches along the longitudinal direction at one location in the circumferential direction. Using these test pieces, forging tests were conducted five times with rolling reduction rates of up to 90% and the rate of occurrence of cracking at the bottoms of the notches (%) was determined. The results are shown in the forgeability column of Table 3.

As will be understood from the above results, in the case of the steel wire rods according to the present invention, no cracking can be observed and the workability is good. On the other hand, in the steel wire rods of the comparative examples, cracking occurred in the range of 50 to 100%. These results are obtained as a result of it being possible to delay the generation of internal microvoids during shape processing in steel wire rod according to the present invention where the shape of the cementite is controlled to make the aspect ratio 2 or less. The reason is that, as shown by the results of observation shown in FIG. 3, the steel wire rod according to the present invention is high in ratio of formation of independent microvoids.

INDUSTRIAL APPLICABILITY

The present invention suppresses the occurrence of wire breakage or fracture during a working operation in typical processes of manufacture using steel wire rod as a material such as wire drawing or cold forging and enables the provision of wire rod having excellent workability. It is a significant invention able to contribute to stabilization of production activities in that field.

The invention claimed is:

1. A steel wire rod comprising steel components including, by mass %, C: 0.20 to 0.60%, Si: 0.15 to 0.30%, Mn: 0.25 to 0.60%, P: ≤0.020%, S: ≤0.010%, and a balance of Fe and unavoidable impurities, and having an inside microstructure including cementite, wherein by number ratio, 80% or more of the cementite in a cross-section vertical to a longitudinal direction of the wire rod has a short axis of 0.1 μm or less and a ratio of a long axis to the short axis, defined as an aspect ratio, of 2.0 or less, wherein the inside microstructure comprises ferrite and bainite structures, and wherein a ratio of lamellar-type structures contained in the inside microstructure is less than 5%.

2. The steel wire rod according to claim 1 further containing, in addition to said steel components, by mass %, one or more of Al: 0.06% or less, Cr: 1.5% or less, Mo: 0.50% or less, Ni: 1.00% or less, V: 0.50% or less, B: 0.005% or less, and Ti: 0.05% or less.

3. A method for production of a steel wire rod comprising heating a billet of a chemical composition according to claim 1 to 950° C. to 1080° C., supplying the billet to a wire rod rolling process to obtain a wire rod, coiling the wire rod in a temperature region of 750° C. to 900° C., then subjecting the wire rod to in-line heat treatment by a molten salt of 400° C. to 430° C., and ejecting the molten salt to the wire rod being dipped in the molten salt at a stirring flow rate of 0.5 m/s to 2.0 m/s in range.

4. A method for production of a steel wire rod comprising heating a billet of a chemical composition according to claims 2 to 950° C. to 1080° C., supplying the billet to a wire rod rolling process to obtain a wire rod, coiling the wire rod in a temperature region of 750° C. to 900° C., then subjecting the wire rod to in-line heat treatment by a molten salt of 400° C. to 430° C., and ejecting the molten salt to the wire rod being dipped in the molten salt at a stirring flow rate of 0.5 m/s to 2.0 m/s in range.

* * * * *